United States Patent [19]

Hotger

[11] Patent Number: 4,565,410

[45] Date of Patent: Jan. 21, 1986

[54] APPARATUS FOR CONTROLLING THE SUPPLY OF HIGH-PRESSURE LIQUID TO A CUTTER DRUM ASSEMBLY

[75] Inventor: Karl Hotger, Bochum, Fed. Rep. of Germany

[73] Assignee: Gebr. Eickhoff Maschinenfabrik und Eisengiesserei mbH, Bochum, Fed. Rep. of Germany

[21] Appl. No.: 559,970

[22] Filed: Dec. 9, 1983

[30] Foreign Application Priority Data

Dec. 18, 1982 [DE] Fed. Rep. of Germany ..... 3246991

[51] Int. Cl.[4] ..... E21F 5/02; E21C 7/08

[52] U.S. Cl. ..... 299/81; 299/12; 299/42

[58] Field of Search ..... 299/81, 12

[56] References Cited

U.S. PATENT DOCUMENTS

| | | | |
|---|---|---|---|
| 3,767,265 | 10/1973 | French et al. | 299/81 |
| 4,049,318 | 9/1977 | Fruin | 299/81 |
| 4,212,497 | 7/1980 | Borowski et al. | 299/81 X |
| 4,368,925 | 1/1983 | Honke | 299/81 X |

*Primary Examiner*—Stephen J. Novosad
*Assistant Examiner*—Michael Goodwin
*Attorney, Agent, or Firm*—Thomas H. Murray; Clifford A. Poff

[57] ABSTRACT

High-pressure liquid is controlled for delivery to nozzles disposed near cutting tools or on the periphery of a shearer drum for a longwall mining machine. The shearer drum includes a central shaft which is extended to project from a support arm for the drum containing drive gearing to rotate the drum. The shaft rotates in the same direction and speed as the drum. The extended end of the shaft is used to support a live seal by which high-pressure liquid is introduced to a central bore in the shaft. Between the live seal and the support arm for the drum, there is provided a casing that does not rotate with the shaft and includes sector recesses in the bore thereof to supply liquid to separate bores in the shaft for controlling the discharge of liquid from valves. The valves are separately controlled by the liquid pressure in the sector recesses so that only nozzles directed to the coal face receive the pressurized liquid.

4 Claims, 3 Drawing Figures

APPARATUS FOR CONTROLLING THE SUPPLY OF HIGH-PRESSURE LIQUID TO A CUTTER DRUM ASSEMBLY

BACKGROUND OF THE INVENTION

This invention relates to an apparatus for controlling the flow of high-pressure liquid in a liquid circuit to a shearer drum which is mounted on a carrying arm wherein the liquid circuit includes a live seal communicating with passageways extending through a shearer drum shaft and acting on valves in the interior of the drum for directing the high-pressure liquid to only those nozzles on the periphery of the drum which are opposite the working face during rotation of the drum.

As disclosed in U.S. Pat. No. 4,212,497, drum shearer loaders for underground mining are provided with nozzles about the periphery of the shearer drum for the delivery of high-pressure liquid to the mine face area. A liquid line extending through the shearer drum shaft and a valve serves to control the discharge of liquid from only those nozzles which are opposite the actual working face. The valve is formed by a recess communicating with the line which extends around the periphery of the drum through an angle corresponding to an actuation zone wherein only those nozzles located therein discharge liquid. The recess is disposed in a component located in the drum hub, for instance, the shaft carrying the drum but not rotatable therewith, or a non-rotating tube disposed centrally inside the drum drive shaft. The recess is masked by means of the hub which extends in a sealed manner around the drum shaft, or by means of the drum shaft which extends in a liquid-tight manner around the tube, both the hub and the drive shaft rotating with the drum. Radial lines extend to the various nozzles or groups of nozzles from the portion of the bore in the hub for the drive shaft which masks the recess.

As disclosed in copending application Serial No. 416,930, assigned to the Assignee of this application, a drum shearer loader for underground mining includes nozzles distributed about the periphery of the shearer drum. The nozzles are controlled so that high-pressure liquid is discharged from only those nozzles which are opposite the working face and communicate with the minerals thereat. The nozzles are controlled by valves communicating with a liquid line extending through the drum shaft. The valves are part of a live seal which rotates with the drum and is disposed inside the drum at the end thereof projecting from a reduction gearing box. The high-pressure liquid is supplied through a stationary drum shaft to control valves which are part of the live seal that rotate with the drum and extend around the drum shaft. The seal is located inside the drum and, therefore, access is difficult. The valves are actuated by a separate liquid circuit. The liquid discharge apparatus disclosed in the aforementioned U.S. Pat. No. 4,212,497 provides that the operative period during which high-pressure liquid is discharged from the nozzles is controlled directly by the drum shaft and the stationary tube in the shaft bore or by the drum shaft and the drum hub therearound.

SUMMARY OF THE INVENTION

It is an object of the present invention to obviate the disadvantages in a shearer drum embodying a construction known in the art and hereinbefore outlined by providing a flow control for high-pressure liquid by means of a live seal and control casing that are readily accessible outside the drum of a shearer drum for a mining machine.

According to the present invention, there is provided a means for controlling the flow of high-pressure liquid through a live seal to a shearer drum mounted on a carrying arm wherein a liquid circuit is provided to extend through the shearer drum shaft and acts on valves situated in the interior of the drum while connected to a high-pressure line extending through a shaft for delivering fluid to only those nozzles of the drum which are opposite the working face.

The present invention provides a shaft which is disposed centrally of the shaft for the shearer drum and rotates at the same speed and in the same direction as the drum. The end of the centrally-disposed shaft together with a high-pressure line and liquid lines for controlling the valves extend through the carrying arm for the shearer drum. The end of the centrally-disposed shaft projecting from the carrying arm carries a live seal through which high-pressure liquid enters the centrally-disposed shaft. The invention further provides a casing to control the actuation of the various valves. In a shearer drum of this type, both the live seal and the casing for controlling the valves are disposed outside the drum on the goaf side, i.e., the side opposite the working face of the carrying arm whereby the seal and the casing can be supervised throughout the use of the mining machine and replaced as required without elaborate assembly procedures.

Conveniently, the casing is mounted on a centrally-disposed shaft for limited rotation around the shearer drum shaft to select the zone on the periphery of the drum where high-pressure liquid is to be discharged from the nozzles to the working face. The casing can be locked at various operative positions with the drum-carrying arm or live seal to maintain the desired discharge of liquid to the working face when the direction of the mining machine travel is reversed. To this end, the bore or duct in the casing is formed with two peripheral recesses that are offset in an axial direction of the duct or bore from one another. Each of the recesses separately communicate with at least one radial bore in the casing. One bore extends to a return line which communicates with a recess extending over a sector angle determined to substantially correspond to the zone of engagement between coal-release tools on the shearer drum and the working face; whereas the other bore extends to a pressure line which communicates with the other recess extending over a region of the casing not associated with the first region. By turning the casing, one can adjust the peripheral region containing nozzles which are to be supplied with high-pressure liquid. The flow of high-pressure liquid to the nozzles is triggered by various valves which are controlled by rotation of the drum. As the drum rotates, the valves supply fluid seriatim with the supply of pressurized oil to the recess or a discharge recess. The oil pressure controls the valves to isolate the nozzles not directed toward the mine face from high-pressure liquid in the bore of the shaft. The absence of the pressurized oil directs the supply of the high-pressure liquid to nozzles presented to or near the working face.

These features and advantages of the present invention as well as others will be more fully understood when the following description is read in light of the accompanying drawings, in which.

Figure 1:
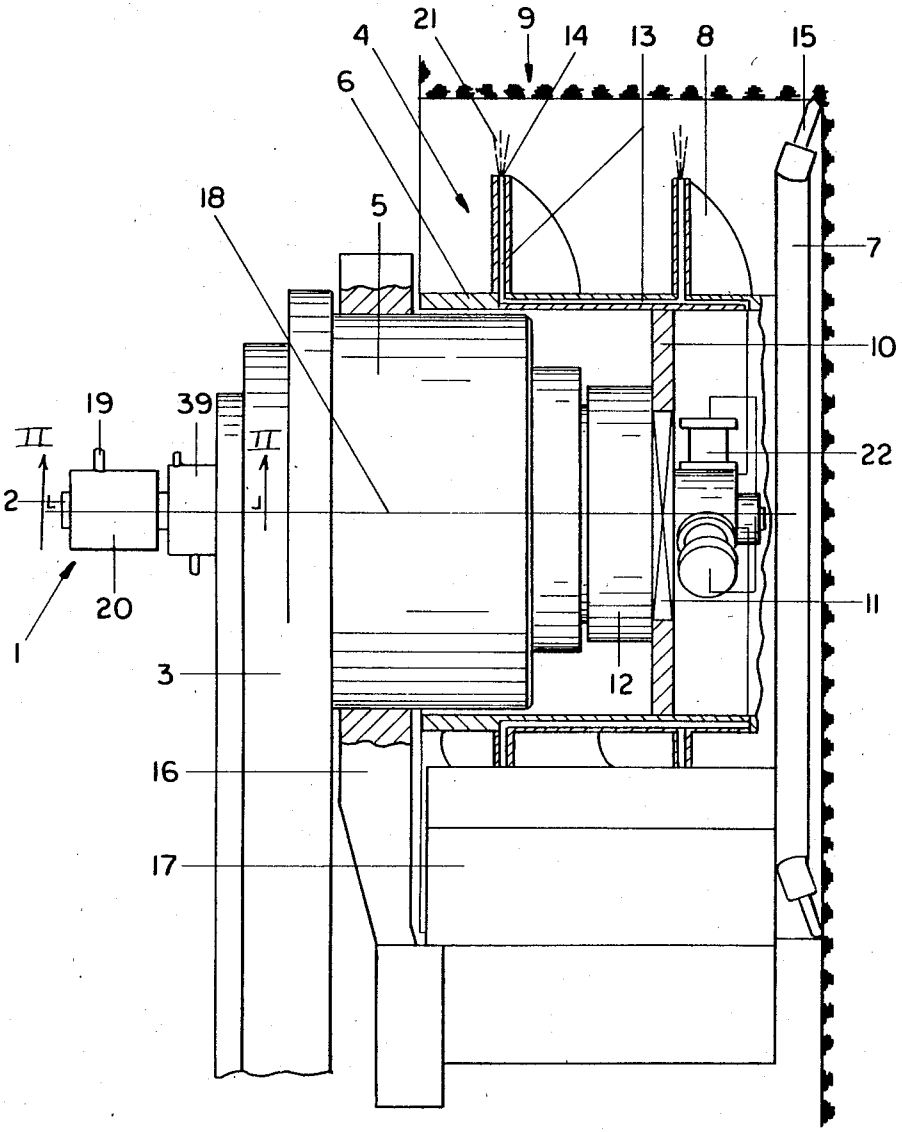
FIG. 1 is an elevational view, partly in section, of a longwall mining machine cutter drum incorporating the apparatus of the present invention.

With reference now to the drawings, and particularly to FIG. 1, a cutter drum assembly for a longwall mining machine is shown which incorporates control means 1 carried by a shaft 2 to rotate therewith at the same speed and in the same direction as the shearer drum or cutter drum assembly 4 rotates. The control means and shaft project to the goaf side, i.e., the side opposite the mine face, from a support arm 3 that carries the drum 4. Support arm 3 is mounted for vertical pivoting movement on the longwall mining machine, not shown. An electric motor on the mining machine is connected through gearing in the arm 3 to reduction gearing 5 which is disposed in the drum 4. A cylindrical outer casing 6 extends about the gearing 5 of the drum. The casing 6 has an outer annular flange or web 7 on its side near the mineral face. The casing is provided around its periphery with one or more helical flights 8 which extend over the whole length of the drum. Cutter picks, not shown, are disposed on the outer periphery of the flights 8 and act to break up that part of the mineral face 9 which is presented to the drum as it rotates, the flights 8 acting to discharge the resulting debris or mined material laterally to a face conveyor, not shown.

The casing 6 is provided internally with a flange 10 coupled by way of a square plate 11 to a flange 12 which is rotated by the reduction gearing 5 and, in turn, rotates the drum 4. The casing 6 and the flights 8 are provided with liquid conduits or bores 13 which are combined in the drum 4 inasmuch as they supply identical segments of the drum periphery with liquid. As shown, the conduits 13 terminate in nozzles 14 which cooperate with cutter tools 15 on flange 7. Extending around the housing of the gearing 5 between the drum 4 and the arm 3 is a clearing plow holder 16 which can be pivoted by a mechanism, not shown, around the central axis 18 of the drum 4. A clearing plow 17 is connected by a releasable connection to the clearing plow holder 16. The plow 17, as is conventional, always covers that part of the drum periphery which is opposite the face 9 and helps to improve the discharge of mined material from the back of the cut.

High-pressure liquid is supplied to the drum 4 through a line 19 and a live seal 20. Streams 21 of high-pressure liquid issuing from the nozzles 14 serve to improve the loosening action of the tools 15 and/or are used for dust control. The discharge of liquid is always restricted to that region of the drum periphery which is near the face region immediately ahead of the cutter drum 4 in the direction of machine movement. Consequently, the mining machine must have a control facility to insure that only those nozzles 14 of the cutter drum 5 which are immediately adjacent face 9 are supplied with high-pressure liquid.

Figure 2:
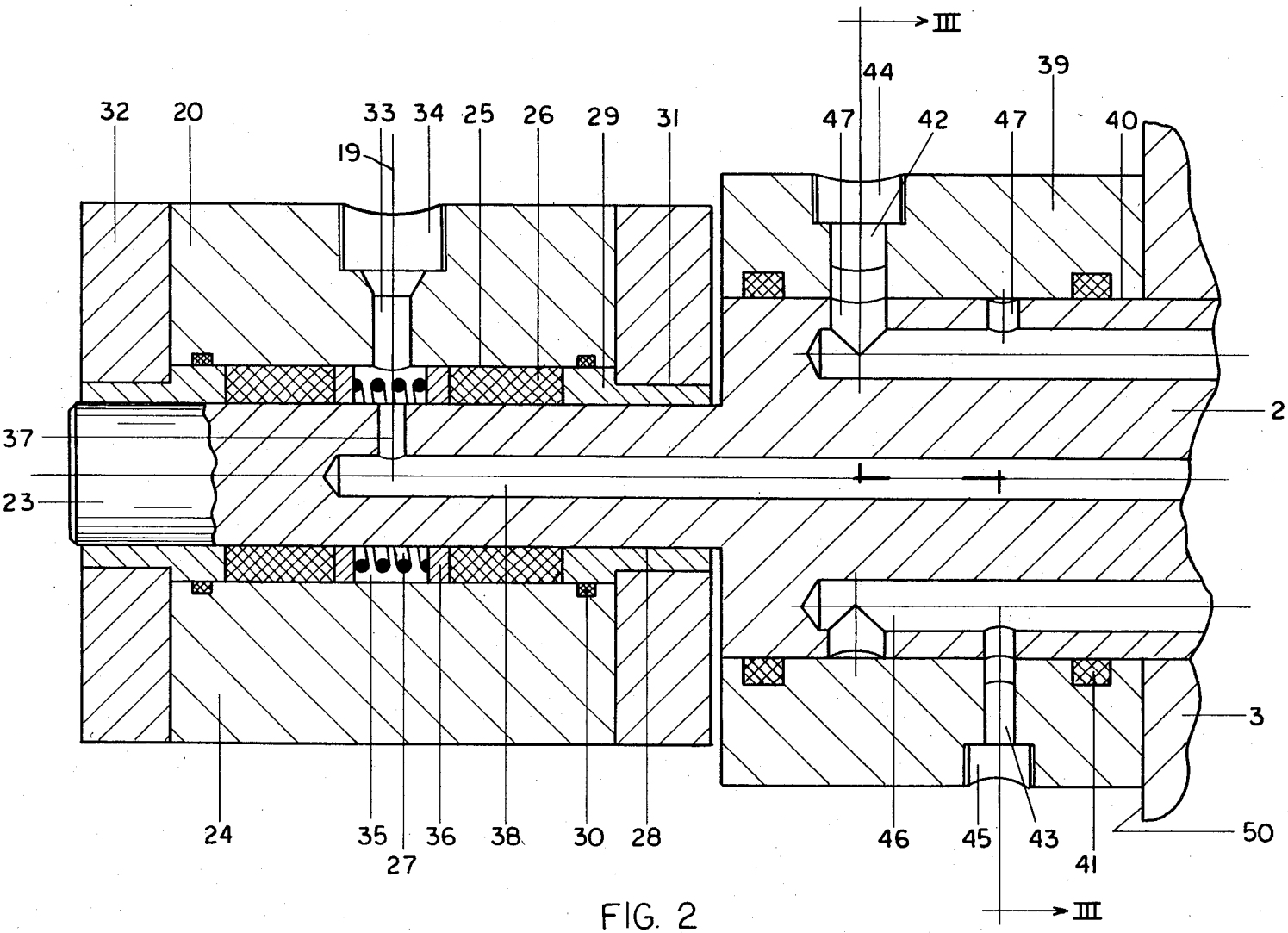
FIG. 2 is a sectional view taken along line II—II of FIG. 1.

The control is provided by special valves 22 disposed inside the drum casing 6. These valves preferably embody a construction disclosed in copending application Ser. No. 416,930 now U.S. Pat. No. 4,471,998. The high-pressure liquid is supplied to the valves 22 through the live seal 20 which is supported against rotation on a reduced-diameter portion 23 of the shaft 2. The reduced-diameter portion 23 extends outwardly from the arm 3. As shown in FIG. 2, a valve casing 24 has a central bore 25 wherein a two-element gland 26 is supported. Gland 26 includes two gland elements which are biased in an axial direction of the shaft by a compression spring 27. Gland 26 is bounded at either end by a bushing 28 having collar portions 29 cooperating with a seal ring 30 arranged in a groove in casing 24. The two bushings 28 are each received in a bore 31 formed in a cover 32 that is attached by screws or other fasteners to the live seal casing 24. The collar portions 29 project from the bore 31. The casing 24 is provided with a radial bore 33 that communicates with a threaded bore extension 34. The compression spring 27 maintains an annular gap 35 between two end discs or plates 36 of the gland 26 so that high-pressure liquid entering the gap flows through a radial bore 37 to a central bore 38 in shaft 2. Bore 38 extends to the valves 22 in the drum 4.

Figure 3:
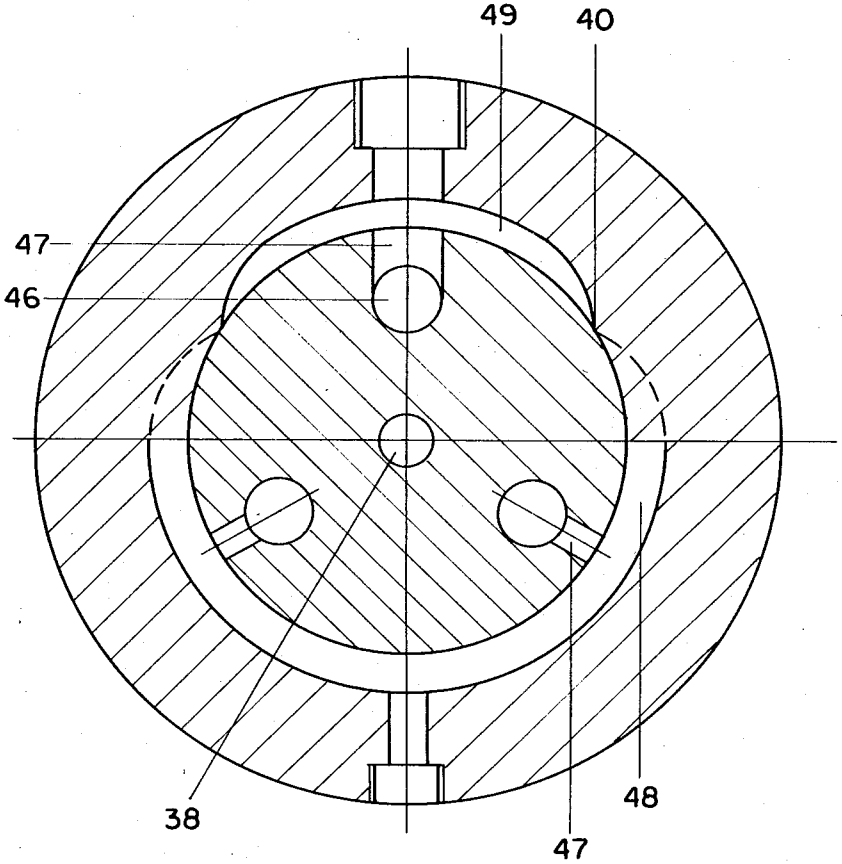
FIG. 3 is a sectional view taken along line III—III of FIG. 2.

The valves 22 are controlled through the agency of a casing 39 which is disposed on the part of the drum shaft which projects from arm 3. The casing 39 can be locked to the arm 3 in different positions. A ring seal 41 is provided at each of the two opposite ends of a bore 40 in the casing 39. The seals 41 extend around the large diameter portions of the shaft 2 and are supported in grooves in the bore 40. Each radial bore 42 or 43 in the casing 39 has threaded bore extensions 44 and 45, respectively. The extensions 44 and 45 as shown in FIG. 2 have different diameters. The bores 42 and 43 are disposed on diametrically-opposite sides and offset from one another in an axial direction of the shaft 2. The shaft 2 in the region of the bores 42 and 43 is provided with three longitudinal bores 46 as shown in FIGS. 2 and 3 located in an equally-spaced relation on a common circle whose center corresponds to the center 18 of the drum shaft. Each of the bores 46 forms a liquid return line extending to one of the valves 22 in the drum 4. As shown in FIG. 2, each bore 46 begins inside the casing 39 at a point communicating with the radial bores 47. The bores 47 have different diameters and extend to the periphery of shaft 2.

As shown in FIG. 3, recesses 48 and 49 are disposed diametrically opposite one another in the bore 40 and in a plane transverse to the bore 40 containing bores 47. The recesses 48 and 49 extend through sector angles which, when combined, form a circle. By this construction, the various longitudinal bores 46 in the shaft 2 rotate with the drum 4 and communicate first with the larger and more extensive recess 48 and then with the smaller or lesser extensive recess 49. The larger recess 48 is permanently coupled to an oil supply line via threaded recess 45 and bore 43 in a continuous manner whereby a pressurized supply of oil is maintained in the larger recess. The pressurized supply of oil in the recess 48 closes off a valve 22 connected to the axial bore or bores 46 communicating therewith. Thus, the pressure of the oil is used to operate the valve or valves 22 to prevent the supply of high-pressure liquid to those nozzles of the drum which are not directed to the mine face. More particularly, as can be seen in FIGS. 2 and 3, the pressurized supply of oil is delivered from recess 48 through radial bores 47 communicating with the two axial bores 46. When a radial bore 47 passes into communication with the smaller recess 49, the associated longitudinal bore 46 is no longer acted upon by the high-pressure oil but receives a supply of pressurized water through a conduit connected to the threaded extension 44 of bore 42. The smaller recess 49 and the water pressure therein is less than the high pressure of the oil in recess 48 which insure that when a longitudinal bore 46 passes by it, the pressure acting on the associated valve 22 is decreased which allows water to flow to the associated nozzles via bore 38.

The casing 39 is adjusted to an angular position on the shaft 2 by the operator of the drum shearer loader such that the sector angle of the smaller recess 49 in the casing bore 40 is the same as the sector angle of the drum periphery presented to the mine face 9. Fasteners, such as threaded bolts, are used to lock the casing to either the live seal 20 or arm 3. Consequently, the angular position of the casing is selected so that high-pressure liquid is supplied only to those nozzles 14 which are opposite the face 9. The pressurized oil to control valves 22 is supplied by branch lines from an oil circuit extending into arm 3 and delivered by such lines, not shown, into the casing 39 disposed between the live seal 20 and the side wall 50 of the arm 3.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. Apparatus for controlling the delivery of high-pressure liquid through a seal to a shearer drum mounted on a carrying arm of a shearer cutter for a longwall mining machine, said shearer drum having on its periphery nozzles for discharging high-pressure liquid onto a face area, said apparatus including a liquid circuit with liquid passageways extending through a shaft arranged centrally to extend through the shearer drum, said circuit further including valves in the interior of said shearer cutter for connecting the liquid passageways extending through said shaft to only those nozzles on the periphery of the drum which are opposite the working face, an arm for carrying the shearer drum through which said shaft extends together with the liquid passageways therein for delivery of high-pressure liquid through passageways therein for controlling said valves, a seal on an end portion of said shaft which projects from said carrying arm for feeding high-pressure liquid to the liquid passageways in said shaft, and means extending along a part of said shaft for controlling the actuation of said valves.

2. The apparatus according to claim 1 wherein said means includes a casing having two recesses offset from each other in an axial direction of the shaft each recess communicating with at least one radial bore in the casing, one of said recesses extending over a sector angle substantially corresponding to a sector angle of the zone of engagement between the shearer drum and said face area for communicating with a passageway forming a return line from said valve and the second of said recesses being separate from said first recess and extending over a sector angle which communicates with a supply of pressurized liquid communicating with said radial bore of the recess.

3. The apparatus according to claim 2 wherein said casing is mounted on said shaft and locked against rotation at a preselected position of said arm.

4. The apparatus according to claim 2 wherein said casing is mounted on said shaft and locked to said live seal against rotation at a preselected position of said arm.

* * * * *